US005517291A

United States Patent [19]

Montfort et al.

[11] Patent Number: 5,517,291

[45] Date of Patent: May 14, 1996

[54] RESONATOR ASSEMBLY INCLUDING AN ADHESIVE LAYER HAVING FREE FLOWING PARTICULATE BEAD ELEMENTS

[75] Inventors: David B. Montfort, Penfield; Charles A. Radulski, Macedon, both of N.Y.

[73] Assignee: Xerox Corporation, Stamford, Conn.

[21] Appl. No.: 332,152

[22] Filed: Oct. 31, 1994

[51] Int. Cl.[6] ..... G03G 15/14

[52] U.S. Cl. ..... 355/273; 228/1.1; 310/321

[58] Field of Search ..... 355/271, 273, 355/274; 228/1.1; 310/320, 321, 325, 326

[56] References Cited

U.S. PATENT DOCUMENTS

| | | | |
|---|---|---|---|
| 3,653,758 | 4/1972 | Trimner et al. | 355/273 |
| 4,111,546 | 9/1978 | Maret | 355/297 |
| 4,666,547 | 5/1987 | Snowden, Jr. et al. | 310/321 |
| 4,713,572 | 12/1987 | Bokowski | 310/323 |
| 4,764,021 | 8/1988 | Eppes | 366/127 |
| 4,987,456 | 1/1991 | Snelling et al. | 355/273 |

*Primary Examiner*—William J. Royer
*Attorney, Agent, or Firm*—Denis A. Robitaille

[57] ABSTRACT

An apparatus for enhancing toner release from an image bearing member in an electrostatographic printing machine, including a resonator suitable for generating vibratory energy arranged in line contact with the back side of the image bearing member for uniformly applying vibratory energy to the image bearing member. The resonator includes a piezoelectric transducer and a horn-type waveguide assembly, wherein an adhesive epoxy augmented with a substantial concentration of electrically conductive, free flowing particulate bead elements is used to bond the horn and piezoelectric transducer element together, without the requirement of a backing plate or bolts. The conductive beads resolve bond layer thickness anomalies while eliminating adhesive flow restrictions such that substantially uniform tip velocity and frequency output can be achieved.

23 Claims, 4 Drawing Sheets

RESONATOR ASSEMBLY INCLUDING AN ADHESIVE LAYER HAVING FREE FLOWING PARTICULATE BEAD ELEMENTS

The present invention relates generally to an apparatus for applying vibratory energy to an imaging surface in an electrostatographic printing machine and, more particularly, relates to the fabrication of a piezoelectric transducer/waveguide horn assembly for creating an ultrasonic resonator suitable for electrostatographic applications.

In a typical electrophotographic printing process, a photoconductive member is initially charged to a substantially uniform potential and the charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoreceptive member is cleaned to remove any residual developing material on the photoconductive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing support surface, such as a photoreceptor, to a second support surface, such as a copy sheet or an intermediate transfer belt, is enabled by overcoming adhesion forces which hold toner particles to the image bearing surface. Typically, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. This corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

Thus, the process of transferring development materials to a copy sheet in an electrostatographic printing system involves the physical detachment and transfer-over of charged toner particles from an image bearing surface to a second surface through the utilization of electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required in order to induce the physical detachment and transfer-over of the charged toner particles without scattering or smearing of the developer material.

The use of vibratory energy has been disclosed, for example in U.S. Pat. No. 3,854,974 to Sato, et al., among other U.S. patents, as a method for enhancing toner release from an image bearing surface. Recently, systems which incorporate a resonator suitable for generating focused vibratory energy, arranged along the back side of the image bearing surface for applying uniform vibratory energy thereto, have been disclosed. In these systems, toner is released from the image bearing surface despite the fact that electrostatic charges in the transfer zone may be insufficient to attract toner from the image bearing surface to the second support surface. Exemplary systems of this nature are disclosed in U.S. Pat. Nos. 4,987,456, and 5,081,500, among other U.S. Parents, the contents of which are completely incorporated by reference herein.

Resonators for applying vibrational energy to some other member are known, for example in U.S. Pat. No. 4,363,992 to Holze, Jr. which shows a horn for a resonator, coupled to a piezoelectric transducer device supplying vibrational energy, and provided with slots partially through the horn for improving non uniform response along the tip of the horn. As exemplified by that patent, which is directed to blade-type welding devices, the horn is coupled to the transducer by means of a bolt type fastener. U.S. Pat. No. 3,113,225 to Kleesattel et al. shows a similar arrangement for other ultrasonic energy applying applications.

U.S. Pat. No. 5,081,500 discloses the use of fasteners extending through a piezoelectric transducer, horn, backplate combination configured for use as a resonator suitable for generating focused vibratory energy in an electrostatographic machine for applying uniform vibratory energy along the back side of the image bearing surface. However, it has been found that, in the application proposed for the release of toner from an image bearing surface, a resonator device of the type described in which clamping force is provided via bolted construction may be problematic in that extreme precision in the tightening of the bolts is required. While the bolt torque can be controlled, the axial compression cannot be easily controlled. Moreover, the bolt-to-thread friction losses are variable and random on a bolt-to-bolt basis. Since any variation in the clamping force will cause asymmetric device behavior, when uniform behavior is sought, it has been found that alternative fabrication techniques that eliminate variable clamping forces are necessary. To that end, that patent also briefly describes the use of an adhesive, such as an epoxy, and a conductive mesh layer for bonding the horn and piezoelectric transducer element together, without the requirement of a backing plate or bolts.

The present invention is directed toward a resonator assembly, particularly for use in electrostatographic applications, incorporating a piezoelectric transducer in combination with a waveguide horn, wherein improved bonding techniques are utilized to eliminate the problems found in prior art devices.

The following disclosures may be relevant to various aspects of the present invention:

U.S. Pat. No. 3,653,758 Patentee: Trimmer et al. Issued: Apr. 4, 1972

U.S. Pat. No. 4,111,546 Patentee: Maret Issued: Sep. 5, 1978

U.S. Pat. No. 4,713,572 Patentee: Bokowski et al. Issued: Dec. 15, 1987

U.S. Pat. No. 4,764,021 Patentee: Eppes Issued: Aug. 16, 1988

U.S. Pat. No. 4,987,456 Patentee: Snelling, et al. Issued: Jan. 22, 1981

The relevant portions of the foregoing disclosures may be briefly summarized as follows:

U.S. Pat. No. 3,653,758 discloses a pressureless non-contact electrostatic printing technique wherein additional force required to dislodge particles from a thin plate is supplied by imparting ultrasonic flexual shock waves to the thin plate.

U.S. Pat. No. 4,111,546 discloses enhancing cleaning by applying high frequency vibratory energy to an imaging surface with a vibratory member, coupled to an imaging surface at the cleaning station to obtain toner release. The vibratory member described is a horn arrangement excited with a piezoelectric transducer (piezoelectric element) at a frequency in the range of about 20 kilohertz.

U.S. Pat. No. 4,713,572 discloses ultrasonic transducers for transmitting and receiving ultrasound in on-line applications, wherein the transducer comprises a piezoelectric element having the shape of a parallelpiped, and a nosepiece rigidly attached to a surface of the piezoelectric element and adapted for contact with sheet material through which ultrasound is propagated. That patent specifically discloses the use of an adhesive, preferably a conductive epoxy, for rigidly attaching the nosepiece to the piezoelectric element.

U.S. Pat. No. 4,764,021 discloses an apparatus for the ultrasonic agitation of liquids, particularly adapted for blood hemolysis. A piezoelectric crystal is sandwiched between a base resonator and a horn resonator with a coating of conductive material such as silver being fired to both sides of the crystal to insure close communication between the crystal and the resonators, an adhesive support system is layered on either side of the crystal. That patent specifically discloses that the adhesive support system preferably consists of a metallic mesh coated with an epoxy bonding material.

U.S. Pat. No. 4,987,456 discloses a resonator suitable for generating vibratory energy arranged in live contact with the back side of a charge retentive imaging member for uniformly applying vibratory energy thereto. The resonator includes a vacuum producing element, a vibratory member, and a seal arrangement, whereby a vacuum is applied at the point of contact with the charge retentive surface to draw the surface into intimate contact engagement with the vibratory member.

Numerous other publications, including commonly assigned U.S. Pat. Nos. 5,016,055 and 5,081,500 disclose methods and apparatus for using vibratory energy in combination with the application of a transfer field for enhanced toner transfer in electrophotographic imaging. The subject matter of those patents is incorporated by reference herein.

In accordance with the present invention, there is provided a resonator assembly for applying uniform vibratory energy to an adjacent surface, comprising a vibratory energy producing element for generating the vibratory energy; a waveguide member coupled to the vibratory energy producing element for directing the high frequency vibratory energy to the surface; and an adhesive layer situated between the vibratory energy producing element and the waveguide member for providing an adhesive bond therebetween, the adhesive layer including a substantial concentration of free flowing particulate bead elements.

Pursuant to another aspect of the present invention, there is provided a system for inducing mechanical release of particles from a surface by inducing vibration thereof, including a resonator assembly for applying uniform vibratory energy to the surface, comprising: a vibratory energy producing element for generating the vibratory energy; a waveguide member coupled to the vibratory energy producing element for directing the high frequency vibratory energy to the surface; and an adhesive layer situated between the vibratory energy producing element and the waveguide member for providing an adhesive bond therebetween, the adhesive layer including a substantial concentration of free flowing particulate bead elements.

In accordance with yet another aspect of the present invention, there is provided in an electrostatographic printing apparatus including a system for enhancing transfer of toner particles from an image bearing member, a resonator assembly for applying uniform vibratory energy to the image bearing member, wherein the resonator comprises: a vibratory energy producing element for generating the vibratory energy; a waveguide member coupled to the vibratory energy producing element for directing the high frequency vibratory energy to the surface; and an adhesive layer situated between the vibratory energy producing element and the waveguide member for providing an adhesive bond therebetween, the adhesive layer including a substantial concentration of free flowing particulate bead elements.

Other aspects of the present invention will become apparent from the following description and the accompanying drawings, in which.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

Figure 4:
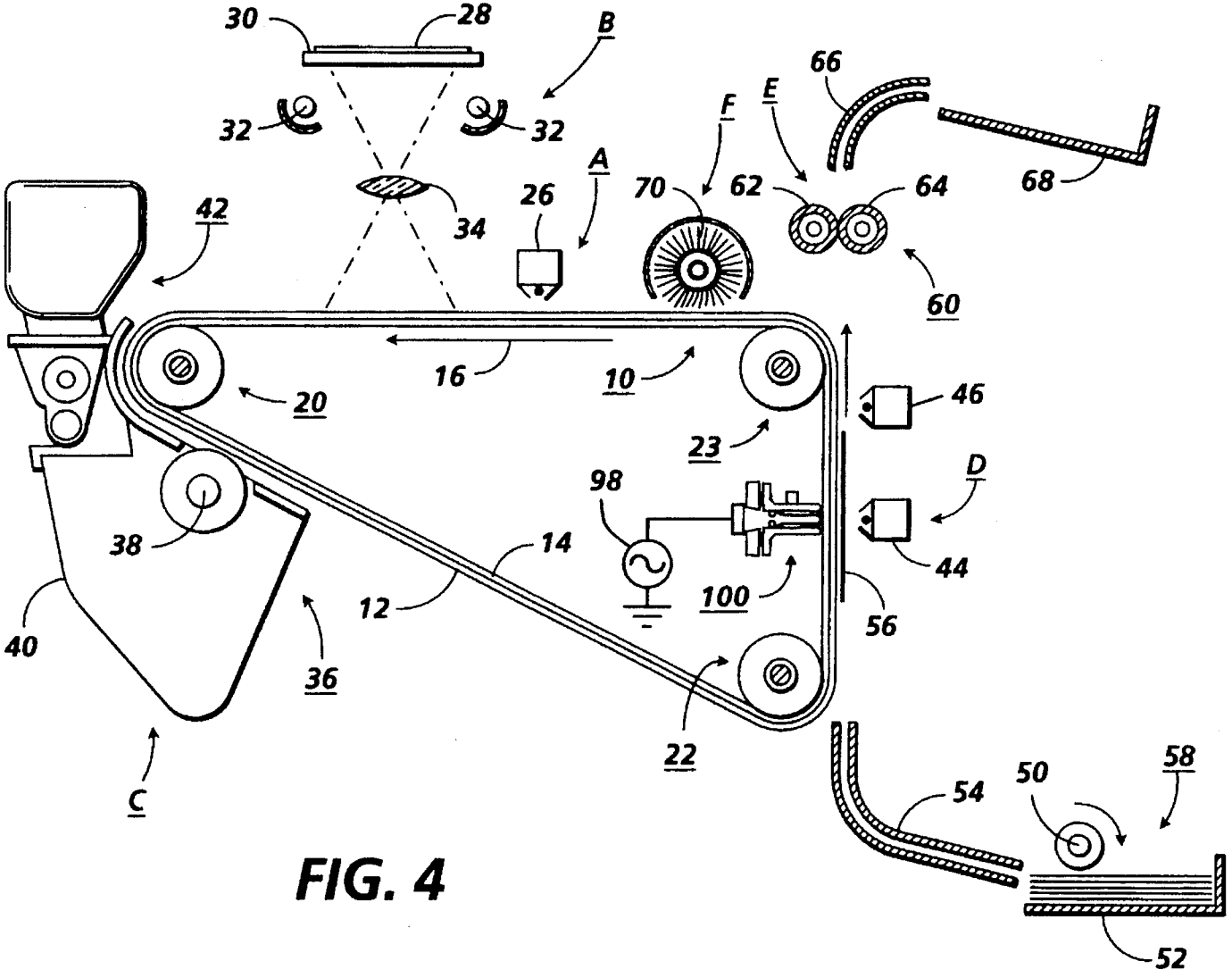
FIG. 4 is a schematic elevational view of an exemplary electrostatographic printing machine including an illustrative embodiment of a transfer enhancement system comprising the ultrasonic resonator arrangement shown in FIG. 1.

For a general understanding of an exemplary printing machine incorporating the features of the present invention, a schematic depiction of the various processing stations, and the machine components thereof, is provided in FIG. 4. Although the resonator assembly of the present invention is particularly well adapted for use with a transfer subsystem in an automatic electrophotographic reproducing machine as shown in FIG. 4, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, such as a development or cleaning subsystem, for example. It will be further appreciated that the present invention is not necessarily limited to the particular embodiment or embodiments shown and described herein.

Thus, prior to discussing the features and aspects of the present invention in detail, a schematic depiction of an exemplary electrophotographic reproducing machine incorporating various subsystems is furnished in FIG. 4, wherein an electrophotographic reproducing apparatus employs a belt 10, including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in the direction of arrow 16 about a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a developer roll 38 disposed in a developer housing 40. Toner particles are mixed with carrier beads in the developer housing 40, generating an electrostatic charge which causes the toner particles to cling to the carrier beads, thereby forming the developing material. The magnetic developer roll 38 is rotated in the developer housing 40 for attracting the developing material to form a "brush" comprising the developer roll 38 with carrier beads with toner particles magnetically attached thereto. As the developer roll 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface and advances the developed image thereon to transfer station D. At transfer station D, a sheet of support material 56, such as paper or some other type of copy sheet or substrate, is moved into contact with the developed toner image on belt 10 via sheet feeding apparatus 58 and chute 54 for synchronously placing the sheet 56 into contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a precisely timed sequence for transfer thereto at transfer station D. A corona generating device 44 is also provided for charging the support material 56 to a potential so that the toner image is attracted from the surface 12 of photoreceptor belt 10 to the sheet 56 while the copy sheet 56 is also electrostatically tacked to photoreceptor belt 10.

With particular reference to the principle of enhanced toner release as provided by a vibratory energy assisted transfer system, the exemplary transfer station D of FIG. 4 includes a vibratory energy producing device such as a relatively high frequency acoustic or ultrasonic resonator 100. The resonator 100 is driven by an AC source 98 and arranged in vibratory relationship with the back side of belt 10 at a position corresponding to the location of transfer corona generating device 44. The resonator 100 applies vibratory energy to the belt 10 for agitating the toner developed in imagewise configuration thereon to provide mechanical release of the toner particles from the surface of the belt 10. Such vibratory energy enhances toner transfer by dissipating the attractive forces between the toner particles and the belt 10. Vibratory assisted transfer, as provided by resonator 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems are described in U.S. Pat. Nos. 4,987,456, 5,016,055 and 5,081,500, among various other commonly assigned patents, which are incorporated in their entirety by reference into the present application for patent. Further details of vibratory assisted toner release in electrostatographic applications can also be found in an article entitled "Acoustically Assisted Xerographic Toner Transfer", by Crowley, et al., published by The Society for Imaging Science and Technology (IS&T) Final Program and Proceedings, 8th International Congress on Advances in Non-Impact Printing Technologies, Oct. 25–30, 1992. The contents of this paper are also incorporated by reference herein.

Continuing with a description of the exemplary electrophotographic printing process, after the transfer step is completed, a corona generator 46 charges the support material 56 with an opposite polarity to release the support material from belt 10, whereupon the sheet 56 is stripped from belt 10. The support material 56 is subsequently separated from the belt 10 and transported to a fusing station E. It will be understood by those of skill in the art, that the support material may also be an intermediate surface or member, which carries the toner image to a subsequent transfer station for transfer to a final support surface. These types of surfaces are also charge retentive in nature. Further, while belt type members are described herein, it will be recognized that other substantially non-rigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support material 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The various machine functions described hereinabove are generally managed and regulated by a controller (not shown), preferably provided in the form of a programmable microprocessor. The microprocessor controller provides electrical command signals for operating all of the machine subsystems and printing operations described herein, including imaging onto the photoreceptor, paper delivery, xerographic processing functions associated with developing and transferring the developed image onto the paper, and various functions associated with copy sheet transport and subsequent finishing processes. As such, the controller initiates a sequencing schedule which is highly efficient in monitoring the status of a series of successive print jobs which are to be printed and finished in a consecutive fashion. Conventional sheet path sensors or switches are also utilized in conjunction with the controller for keeping track of the position of documents and the sheets in the machine. In addition, the controller regulates the various positions of gates and switching mechanisms, which may be utilized depending upon the system mode of operation selected. The controller may provide time delays, jam indications and fault actuation, among other things. The controller generally provides selectable option capabilities via a conventional user interface which allows operator input through a console or graphic user interface device (not shown) coupled to the controller.

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

With particular reference to the principle of enhanced toner release as provided by the vibratory energy assisted transfer system described hereinabove, a resonator assembly is arranged in vibrating relationship with the back side of belt 10, at a position in substantial alignment with corona generating device 44. The resonator 100 induces vibration of belt 10 which, in turn, agitates the toner particles making up the developed image on belt 10, thereby inducing mechanical release of the toner from the surface of belt 10 and allowing more efficient electrostatic attraction of the toner to a copy sheet during the transfer step. In a preferred arrangement, the resonator 100 is configured such that the vibrating surface thereof is parallel to belt 10 and transverse to the direction of belt movement 16, with a length approximately co-extensive with the belt width. The particular features of the resonator 100 and the additional aspects provided by the present invention will be discussed in greater detail hereinbelow.

Figure 1:
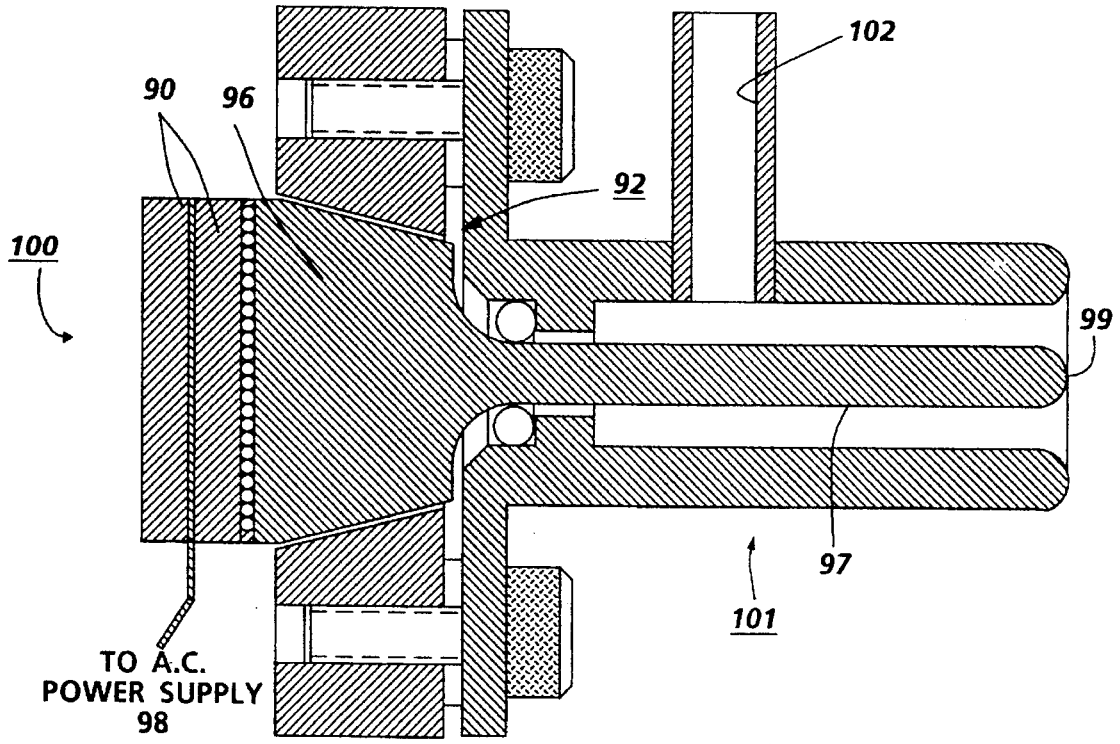
FIG. 1 is a cross-sectional view of a piezoelectric transducer/horn waveguide assembly making up an ultrasonic resonator in accordance with the present invention.

Referring to FIG. 1, resonator 100 is preferably a relatively high frequency acoustic or ultrasonic-type assembly which includes a vibratory energy producing element such as a piezoelectric transducer element 90 for generating vibratory energy. The piezoelectric transducer element 90 is coupled to an A.C. source 98 for driving the resonator 100 at a frequency between 20 kHz and 200 kHz, and typically at approximately 60 kHz. A waveguide member 92 is coupled to the piezoelectric transducer element 90 for transmitting the vibratory energy emitted therefrom. The waveguide member 92 is preferably fabricated from aluminum, having a platform portion 96, a horn element 97 and a contacting tip 99 for contacting belt 10 to impart the vibratory energy of the resonator 100 thereto. It will be understood that other shapes, such as an exponential shape, a conical shape, or the like may also be employed. As shown, the transducer element 90/horn-type waveguide member 92 assembly is preferably configured in association with a vacuum plenum arrangement 101, including a vacuum supply 102 (vacuum source not shown). This arrangement provides positive contact engagement between the contacting tip 99 of waveguide member 92 and the photoreceptor belt 10, wherein the tip 99 may or may not penetrate the normal plane of the photoreceptor belt 10 for transmitting vibratory energy from the resonator 100 and focusing the energy at a predetermined point on the photoreceptor belt 10.

As discussed in the background of the present application, a typical resonator of the type described hereinabove may be supported on a backplate (not shown), with fasteners (not shown) extending through the backplate, the piezoelectric transducer element 90 and the horn 97 may be provided in order to hold the arrangement together. However, as also previously discussed, it has been found that it is advantageous to eliminate the backplate and fasteners in order to increase uniformity of the output frequency generated by the resonator along the length thereof and to reduce tolerances required in construction of the resonator 100. Relative tip velocity in a bolted construction versus a bonded construction has been shown to improve tip velocity uniformity across the length of the resonator from ±68% to ±20%. In a known embodiment, as disclosed in U.S. Pat. No. 5,210,577, an adhesive such as an epoxy and a conductive mesh layer have been disclosed for bonding the waveguide member 92 and the piezoelectric transducer element 90 together, eliminating the requirement for a backing plate or bolts. In that patent, a nickel coated monofilament polyester fiber mesh (from Tetko, Inc.) having a mesh thickness on the order of 0.003" thick encapsulated in a thermosetting epoxy having a thickness of 0.005" (before compression and heating) was disclosed. That patent also discloses other meshes, including metallic meshes of phosphor bronze and Monel, which have been suggested as being satisfactory. Two part cold setting epoxies may also be used, as may other adhesives.

In the fabrication of a bonded resonator assembly as described above, it has been discovered that the thickness of the adhesive layer (as gauged by the thickness of the mesh) and the mechanical modulus or the elasticity characteristics of the mesh are critical in determining the frequency response and velocity uniformity characteristics of the resonator. In addition, it has been found that the use of a mesh type material in the adhesive bonding layer tends to cause restrictions in adhesive flow which may result in the formation of voids in the adhesive layer. These voids also form a source of asymmetric frequency response and nonuniform velocity characteristics for the resonator.

Figure 2:
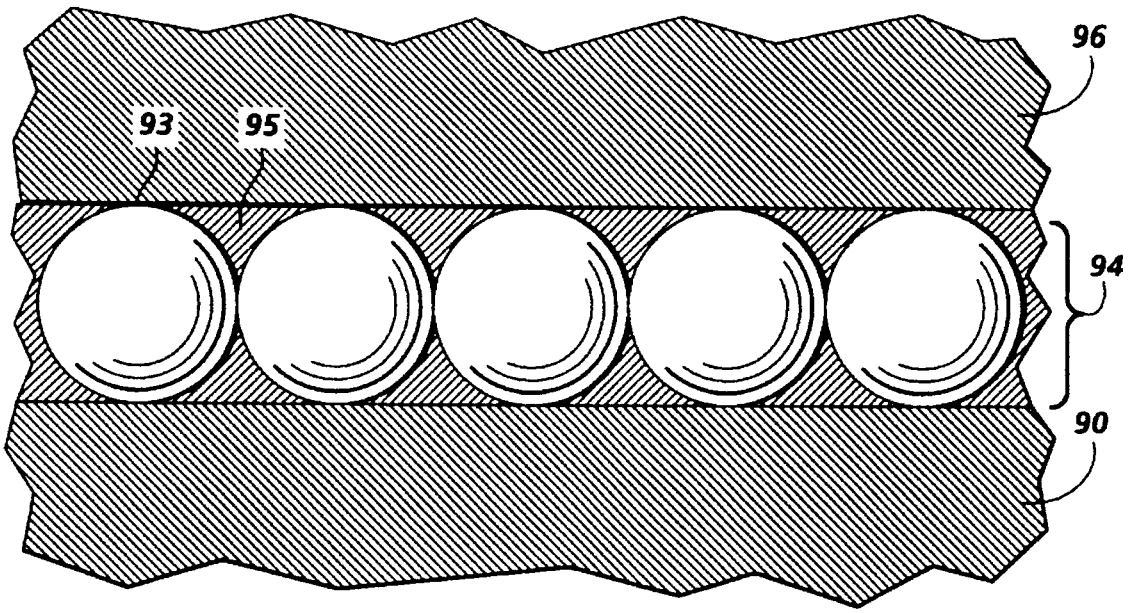
FIG. 2 is an exploded cross sectional view of the interface between the piezoelectric transducer and the horn waveguide, showing the conductive bead filled adhesive layer for bonding the piezoelectric transducer and the horn waveguide in accordance with the present invention.
Figure 3:
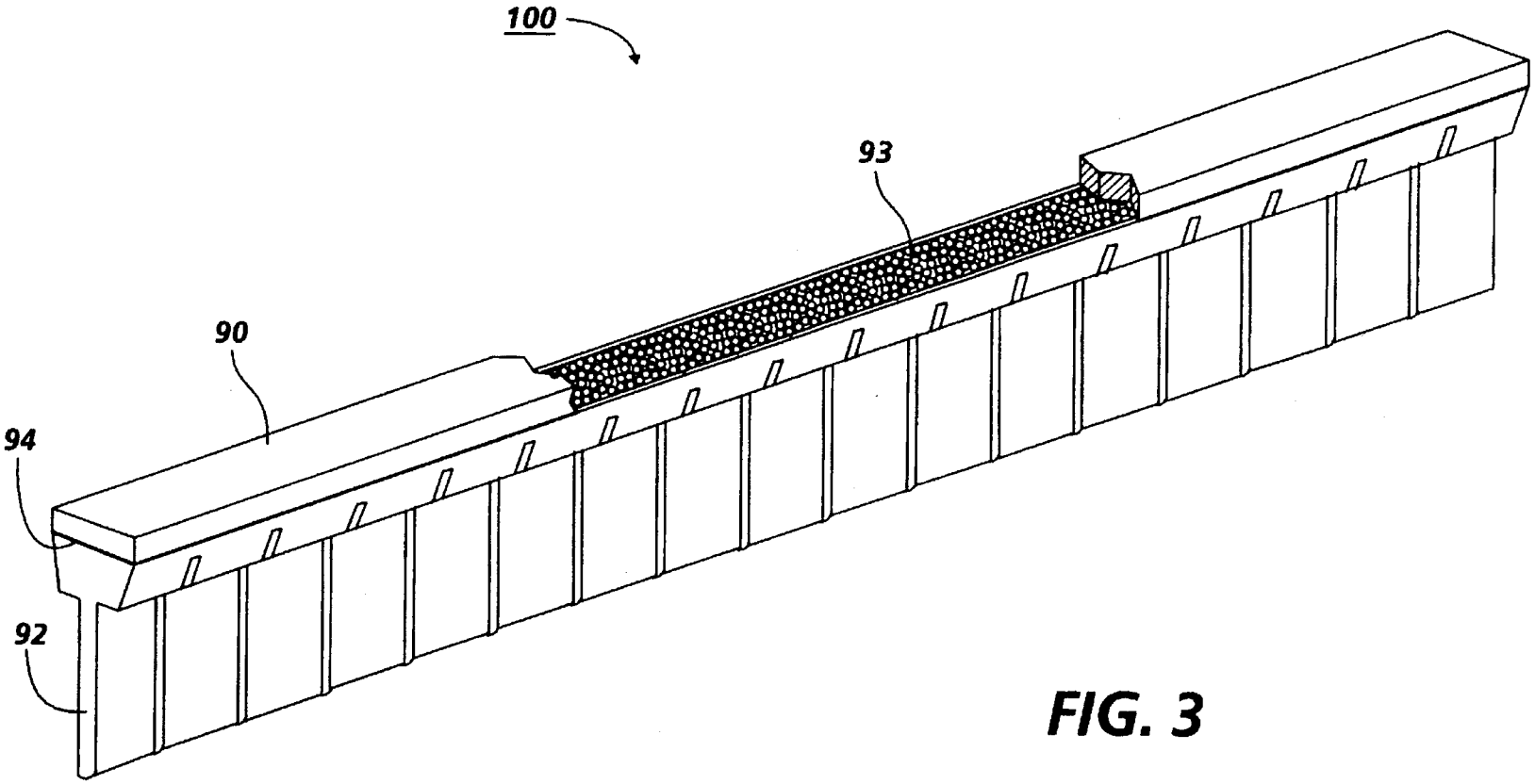
FIG. 3 is a perspective cutaway view of an ultrasonic resonator, showing the conductive bead filled adhesive layer of FIG. 2.

Thus, in accordance with the present invention, the resonator 100 is fabricated by means of a bonded construction. Referring to FIGS. 2 and 3, the adhesive layer 94, sandwiched between the waveguide member 92 and the piezoelectric transducer element 90, is comprised of an adhesive material 95, such as epoxy, and is augmented with free flowing rigid structural elements which may include conductive particulate bead elements. In a preferred embodiment, the free flowing rigid structural elements include substantially spheric metal beads 93 which are advantageously chosen to have a precise dimension in order to meet critical bond or adhesive layer thickness requirements while minimizing restriction of adhesive flow, which may cause the formation of voids in the adhesive layer 94. It is further noted that it is particularly desirable to utilize free flowing rigid structural elements having a particularly high modulus of elasticity. This high modulus provides the capability to use a relatively high clamping pressure while maintaining the selected dimension of the adhesive layer 94.

An exemplary resonator assembly in accordance with the present invention which has proven to provide satisfactory results was fabricated using a two-part epoxy mixture supplemented with a 25% concentration by weight quantity of spheric metal beads. The two-part epoxy mixture comprised a 100 to 16 ratio of A24 adhesive mixed with 24LV hardener, distributed by Emerson and Cumming, Inc. The spheric metal beads were ferrite (pure iron), having a modulus of elasticity on the order of $15\times10^6$ psi and a diameter of approximately 65 microns. During fabrication, the assembly is clamped together to ensure good flow of the epoxy to all surfaces. The clamping pressure was 300 psi and the assembly was cured at a temperature of 130 degrees Fahrenheit. The concentration level of the beads and the clamping pressure utilized during fabrication become critical factors in forcing the beads to become situated along a single plane, thereby defining the thickness of the adhesive layer itself.

In review, the present invention describes a resonator assembly and a method of making such an assembly, fabricated by means of a bonded construction, wherein an adhesive layer is sandwiched between a waveguide member and a piezoelectric transducer element. The adhesive layer is comprised of an adhesive material augmented with free flowing rigid structural elements such as substantially spheric metal beads which provide a vehicle for establishing a uniform thickness to the adhesive layer. Providing a uniform thickness across the length of the adhesive layer results in substantially uniform waveguide velocity and concomitant symmetric frequency response characteristics for the resonator. In addition, the use of free flowing rigid structural elements eliminates adhesive flow restriction as may arise in prior art applications. The conductive beads may also serve to provide the electrical path between the piezoelectric elements and the AC voltage source or electrode.

It will be appreciated that the inventive resonator arrangement has equal application in the cleaning station of an electrophotographic device with little variation. Accordingly, the resonator assembly may be arranged in close relationship to the cleaning station F, for the mechanical release of toner from the surface prior to cleaning. Additionally, improvement in preclean treatment is believed to occur with application of vibratory energy simultaneously with preclean charge leveling; the present invention may also be appropriately configured for this application.

It is, therefore, evident that there has been provided, in accordance with the present invention, a resonator assembly that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. A resonator assembly for applying uniform vibratory energy to an adjacent surface, comprising:

a vibratory energy producing element for generating the vibratory energy;

a waveguide member coupled to said vibratory energy producing element for directing the vibratory energy to the surface; and an adhesive layer situated between said vibratory energy producing element and said waveguide member for providing an adhesive bond therebetween, said adhesive layer including a substantial concentration of free flowing particulate bead elements.

2. The resonator assembly of claim 1, wherein said particulate bead elements include electrically conductive beads.

3. The resonator assembly of claim 1, wherein said particulate bead elements include substantially spheric shaped metal beads.

4. The resonator assembly of claim 3, wherein said substantially spheric shaped metal beads have a diameter of approximately 65 microns.

5. The resonator assembly of claim 1, wherein said particulate bead elements have a modulus of elasticity of approximately $15\times10^6$ psi.

6. The resonator assembly of claim 1, wherein said particulate bead elements are arranged in said adhesive layer so as to be situated in a single plane.

7. The resonator assembly of claim 1, wherein said adhesive layer comprises an epoxy material.

8. The resonator assembly of claim 1, wherein the vibratory energy producing element includes a piezoelectric transducer.

9. The resonator assembly of claim 1, further including a voltage source for driving said vibratory energy producing element.

10. The resonator assembly of claim 1, further including a vacuum apparatus for drawing the adjacent surface toward said resonator assembly.

11. A system for inducing mechanical release of particles from a surface by inducing vibration thereof, including a resonator assembly for applying uniform vibratory energy to the surface, comprising:

a vibratory energy producing element for generating the vibratory energy;

a waveguide member coupled to said vibratory energy producing element for directing the vibratory energy to the surface; and an adhesive layer situated between said vibratory energy producing element and said waveguide member for providing an adhesive bond therebetween, said adhesive layer including a substantial concentration of free flowing particulate bead elements.

12. The system of claim 11, wherein said particulate bead elements include electrically conductive beads.

13. The system of claim 11, wherein said particulate bead elements include substantially spheric shaped metal beads.

14. The system of claim 13, wherein said substantially spheric shaped metal beads have a diameter of approximately 65 microns.

15. The system of claim 11, wherein said particulate bead elements have a modulus of elasticity of approximately $15\times10^6$ psi.

16. The system of claim 11, wherein said particulate bead elements are arranged in said adhesive layer so as to be situated in a single plane.

17. The system of claim 11, wherein said adhesive layer comprises an epoxy material.

18. The system of claim 11, wherein the vibratory energy producing element includes a piezoelectric transducer.

19. The system of claim 11, further including a voltage source for driving said vibratory energy producing element.

20. The system of claim 11, further including a vacuum apparatus for drawing the surface toward said resonator assembly.

21. An electrostatographic printing apparatus including a system for enhancing transfer of toner particles from an image bearing member, including a resonator assembly for applying uniform vibratory energy to the image bearing member, comprising:

a vibratory energy producing element for generating the vibratory energy;

a waveguide member coupled to said vibratory energy producing element for directing the vibratory energy to the image bearing member; and an adhesive layer situated between said vibratory energy producing element and said waveguide member for providing an adhesive bond therebetween, said adhesive layer including a substantial concentration of free flowing particulate bead elements.

22. The electrostatographic printing apparatus of claim 21, further including means for electrostatically attracting the toner particles from the image bearing member to an adjacent surface.

23. The electrostatographic printing apparatus of claim 22, wherein said resonator assembly and said electrostatic attracting means are in substantial alignment with one another.

* * * * *